US008801901B1

(12) United States Patent
Wiley

(10) Patent No.: US 8,801,901 B1
(45) Date of Patent: Aug. 12, 2014

(54) SIZED FLUFF PULP

(71) Applicant: Weyerhaeuser NR Company, Federal Way, WA (US)

(72) Inventor: James H. Wiley, Tacoma, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 0 days.

(21) Appl. No.: 14/144,243

(22) Filed: Dec. 30, 2013

(51) Int. Cl.
*D21F 11/00* (2006.01)

(52) U.S. Cl.
USPC ..... 162/158

(58) Field of Classification Search
USPC ..... 162/158, 123, 203, 205, 207, 209
See application file for complete search history.

(56) References Cited

U.S. PATENT DOCUMENTS

| | | | |
|---|---|---|---|
| 3,212,961 | A | 10/1965 | Weisgerber |
| 3,901,238 | A | 8/1975 | Gellert et al. |
| 5,071,675 | A | 12/1991 | Gupta et al. |
| 5,163,931 | A | 11/1992 | Aldrett |
| 5,938,894 | A | 8/1999 | Thebrin et al. |
| 6,607,636 | B2 | 8/2003 | Ross et al. |
| 7,815,841 | B2 | 10/2010 | Merkley et al. |

FOREIGN PATENT DOCUMENTS

| | | | |
|---|---|---|---|
| CA | 2424377 | A1 | 11/2002 |
| WO | 2013067555 | A1 | 5/2013 |
| WO | 2013067556 | A1 | 5/2013 |

OTHER PUBLICATIONS

M. K. Gupta, Tappi, Mar. 1980, vol. 63, No. 3 p. 29.
D.H. Dumas, Tappi, , vol. 64, No. 1, p. 43, Jan. 1981.

*Primary Examiner* — Mark Halpern
(74) *Attorney, Agent, or Firm* — Timothy M. Whalen; Weyerhaeuser Law Dept

(57) ABSTRACT

Embodiments of sized fluff pulp, or fluff pulp treated with a sizing agent, have desirable characteristics for one or more intended applications. The sized fluff pulp can be debonded or non-debonded. In several examples, the one or more desirable characteristics includes a reduction in its absorption characteristics (e.g., the pulp is less hydrophilic). Some characteristics improved by the sized fluff pulp include, but are not limited to, soak and drip capacity and wicking rate. In several examples, the sized fluff pulp are less hydrophilic but retain or exhibit other desirable characteristics for producing non-wovens, including low fiberization energy and fiberized knot percentage.

20 Claims, 2 Drawing Sheets

SIZED FLUFF PULP

BACKGROUND

Wood pulp fibers are valued for their low cost and ease of handling. Wood pulp fibers are also compostable and renewable and can be grown on land typically not suitable for food crops.

Wood pulp fibers are produced by either mechanical pulping or chemical pulping. Wood, which is a composite structure in which mostly cellulosic fibers are held together with hemicellulose and lignin, is broken down during the pulping process so that individual fibers are obtained. Mechanical pulping uses various types of grinding to accomplish this task and most of the hemicellulose and lignin are retained. Chemical pulping, on the other hand, uses chemicals to break the bonds holding the composite structure together and most of the lignin is dissolved and removed.

Pulps are generally characterized in the industry as paper-grade pulp or fluff pulps. Paper-grade pulps, derived from either hardwoods or softwoods, are used in the manufacture of paper, tissue, and packaging. Paper-grade pulps are typically sold in a heavy-weight sheet form similar to cardboard, with densities greater than 0.700 grams/centimeter$^3$. The paper-grade pulp sheets are packaged as discontinuous sheets that are stacked up to form bales.

To make articles with paper-grade pulp, the baled paper-grade pulp is introduced into a hydropulper and a slurry is formed. In the hydropulper, the paper-grade pulp fibers are redispersed in water by aggressive mechanical agitation. Consequently, moisture content of paper-grade pulps is typically disregarded, and thus, the high costs associated with pulp drying are avoided. As a result, paper-grade pulps have a moisture content greater than 10% and in some cases as high as 20-25% or more. Further, the high densities (greater than 0.700 g/cm$^3$) of paper-grade pulp do not pose a problem as the aggressive mechanical agitation easily disperses the fibers into a slurry suitable for paper-making.

Fluff pulps are typically employed in the manufacture of non-wovens. Non-wovens are fibrous webs or fabrics in which the fibers are neither woven nor knitted. Non-wovens are typically made by dry-laying processes, such as airlaying, spunbonding, hydroentangling, etc. As such, and in contrast with paper-grade pulp, fluff pulp has a moisture content of 10% or less. Fluff pulps are typically made from long fibered softwoods, such as loblolly pine. Fluff pulps are dried in a continuous sheet form and wound onto rolls.

Currently available fluff pulp is quite hydrophilic, limiting the uses of fluff pulp to adsorbents, such as diapers, feminine hygiene products, incontinence products, etc. Since fluff pulp is economical, the pulp industry is constantly striving to produce new applications for fluff pulps.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a fluff pulp sheet is provided. The fluff pulp sheet comprises a composition that includes pulp fibers and a sizing agent. The composition has a soak and drip capacity of less than 15 grams/gram, and an air laid pad wicking rate of less than 3.0 mm/s. The fluff pulp sheet in some embodiments has a density of less than 0.650 g/cm$^3$ and a moisture content of less than 10%.

In accordance with another aspect of the present disclosure, a fluff pulp sheet is provided. The fluff pulp sheet comprises a composition that includes wood pulp fibers, a debonding agent, and a sizing agent, wherein the composition has a soak and drip capacity of less than 15 grams/gram, an air laid pad wicking rate of less than 3.0 mm/s. The fluff pulp sheet is some embodiments has a moisture content of less than 10%, and a density of less than 0.650 g/cm$^3$.

In accordance with another aspect of the present disclosure, a fluff pulp sheet, comprising fluff pulp fibers and a sizing agent. The fluff pulp sheet in some embodiments has a soak and drip capacity of less than 15 grams/gram, an air laid pad wicking rate of less than 3.0 mm/s, a fiberization energy of less than 120 kJ/k, and a fiberized knot percentage of less than 30 percent.

The concepts, features, methods, and component configurations briefly described above are clarified with reference to the accompanying drawings and detailed description below.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1:
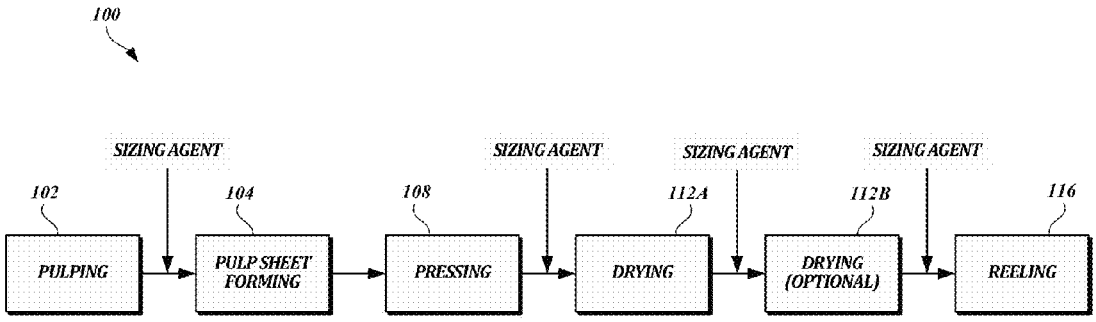
FIG. 1 illustrates a representative production process for a fluff pulp sheet in accordance with aspects of the present disclosure.

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed. Similarly, any steps described herein may be interchangeable with other steps, or combinations of steps, in order to achieve the same or substantially similar result.

The following discussion provides examples of fluff pulps treated with a sizing agent (hereinafter referred to as sized fluff pulp) in order to realize desirable characteristics for one or more intended applications. Several examples set forth in the present disclosure may include debonded or non-debonded, sized fluff pulps, sized Kraft fluff pulps, etc., that include one or more desirable characteristics, including a reduction in its absorption characteristics (e.g., less hydrophilic). As will be described in more detail below, some characteristics improved by the fluff pulp of the present disclosure include but are not limited to soak and drip capacity and wicking rate. As will be further described in more detail below, examples of the sized fluff pulp are less hydrophilic but retain or exhibit other desirable characteristics for producing non-wovens, including low fiberization energy and fiberized knot percentage.

"Fiberization Energy" as used herein means the amount of energy in kilo Joules required to fiberize one kilogram of pulp in dry sheet form. Fiberization is the process of breaking apart a dry pulp sheet into individualized fibers. The section entitled "Test Methods" provides a test procedure in which a hammermill, commercially available from Kamas Laboratory, is used to measure fiberization energy as the pulp sheets are fiberized.

"Knots" are fiber bundles and pieces of the pulp sheet that have not fully broken apart during the fiberization process. Knots are defined herein as the fraction of the fiberized fluff that is retained on an ASTM 12 mesh screen. "Knot percentage" or "Fiberized Knot percentage" as used herein means the percentage of knots (vs. accepts). The section entitled "Test Methods" provides a test procedure for measuring the weight fractions of accepts, knots and fines in a fiberized fluff sample.

"Soak and drip capacity" as used herein means the weight of test liquid retained by a fiberized fluff pulp specimen after the specimen has been submerged in the test liquid for 30 minutes and then allowed to drip for three (3) minutes. The soak and drip capacity is expressed as the weight of liquid absorbed to the original weight of the test specimen. The section entitled "Test Methods" provides a test procedure for measuring soak and drip capacity.

"Air laid pad wicking rate" as used herein means the rate, in millimeters/second, that a test fluid will wick through an airlaid pad containing four (4) grams of fluff under load of 2.5 kilopascals. The section entitled "Test Methods" provides a test procedure for measuring wicking rate in airlaid pads.

One intended application for the sized fluff pulps of the present disclosure includes but is not limited to non-woven disposable wipes, including wipes to which a saturant, such as a surfactant, is applied. Disposable wipes are usually manufactured from non-wovens containing conventional fluff pulp and a quantity of saturant. To be effective, a selected amount of saturant is needed at the surface of the wipes so that, when the wipe is used, the saturant will transfer to the surface being cleaned (e.g., hands, countertops, etc.). In disposable wipes manufactured with conventional fluff pulp, a hydrophilic material, a larger quantity of saturant than is transferred during use is required, due to the hydrophilicity of the pulp retaining some saturant in the wipe. Contrastingly, a sized fluff pulp (i.e., one that is less hydrophilic than conventional fluff pulps), according to aspects of the present disclosure, is beneficial for use in the manufacture of disposable wet wipes in that it reduces the amount of saturant added in the manufacturing process because less saturant will be retained by the fluff pulp when the wipe is used. This may result in lowered costs due to decreased saturant cost, less shipping cost, and so forth.

Other intended applications may benefit from a sized fluff pulp having a reduction in its absorption characteristics, such as wet wipes for absorbing oil and other oleophilic substances, diaper liners, paper towels, among others.

In certain embodiments, the pulp used to form the pulp sheets of the present disclosure includes cellulose pulp or wood pulp. "Cellulose pulp" or "wood pulp" as used herein refers to the product resulting from the wood pulping process. The pulping process can be either mechanical, chemical, or both (e.g., hybrid processes such as chemithermomechanical pulping (CTMP)). The pulped fibers can be bleached or non-bleached. In some embodiments, the chemical process known as "kraft pulping" is employed, although other chemical pulp processing, such as sulfite processing, can be employed. Kraft and sulfite pulping processes are known to those of skill in the art and will not be discussed in detail herein.

The fluff pulping raw materials in some embodiments are sources of cellulose, hemicellulose and lignin and the terms "wood" or "tree" is used herein to generically describe any source of cellulose, hemicellulose and lignin. In the wood pulping industry, trees are conventionally classified as either hardwood or softwood. Examples of softwood species from which fluff pulp is formed include, but are not limited to: fir such as Douglas fir and Balsam fir, pine such as Eastern white pine and Loblolly pine, spruce such as White spruce, larch such as Eastern or Siberian larch, cedar, and hemlock such as Eastern and Western hemlock. In certain embodiments, the fluff pulp is a southern bleached softwood kraft (SBSK) pulp. Alternatively, fluff pulps in some embodiments of the present disclosure may also utilize hardwoods as the source of wood for the pulp, or a combination of softwood and hardwoods.

While the various aspects of the present disclosure are presented in terms of examples related to pulp derived from wood, it will be appreciated that the disclosed examples are illustrative in nature, and therefore, should not be construed as limited to wood pulp applications. It should therefore be apparent that these various aspects of the present disclosure have wide application, and can be employed with pulp derived from any source, such as fiber crops, etc.

As will be described in more detail below, in some embodiments, during the fluff pulp manufacturing process, debonders or debonding agents may be used. Debonders are surface active chemicals that are added prior to, or during, the forming and drying operation of the fluff pulp manufacturing process. The purpose of debonders is to reduce the amount of fiber-fiber bonding that takes place during drying. Examples of debonding agents are Evonik Arosurf® PA 777 and PA 780, Eka Soft™ F509 HA, F587 and F639. The fluff pulps of the present disclosure can be treated with other debonders as well.

As will be fully described in more detail below, during the fluff pulp sheeting process, sizing agents may be used. Sizing agents are chemicals that are added prior to, during, or after the sheet forming process. The purpose of the sizing agent is to increase water resistance of the fiber or fibers. Generally speaking, sizing agents are amphiphilic molecules, having both hydrophilic (water-loving) and hydrophobic (water-repelling) ends. The sizing agent adheres to substrate fibers and tends to form a film, with the hydrophilic tail facing the fiber and the hydrophobic tail facing outwards, imparting a smooth finish that tends to be water-repellent. Examples of sizing agents include alkyl succinic anhydrides (ASAs), alkyl ketene dimers (AKDs), polysiloxanes, rosin, starches, gums, and so forth. The fluff pulps of the present disclosure can be treated with other sizing agents as well.

The sized fluff pulp sheets of the present disclosure can be employed in the manufacture of non-woven articles, such as disposable wipes, paper towels, etc. In that regard, the sized fluff pulp sheets are fiberized in order to obtain individual fluff pulp fibers. Next, the individual fluff pulp fibers are used to manufacture the non-woven article via dry-laying processes, such as airlaying, spunbonding, hydroentangling, etc. In some embodiments, the fluff pulp fibers are mixed with non-fluff pulp fibers prior to the dry-laying process. For example, synthetic fibers, such as polypropylene, polyester, etc., can be mixed with the fluff pulp fibers. Other fibers may be additionally or alternatively included, such as natural fibers, including cotton, etc. The additional non-fluff pulp fibers can be employed to obtain desired characteristics, or to enhance the characteristics obtained from the sized fluff pulp fibers. The amount of added non-fluff pulp fibers can be, for example, from 2% to 20% by weight or greater.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. In some instances, some process steps are not described in detail in order to not unnecessarily obscure various aspects of the present disclosure. Further, it will be appreciated that embodiments of the present disclosure may employ any combination of features described herein.

FIG. 1 illustrates in block diagrammatic form, one representative process 100 for forming fluff pulp sheets in accordance with aspects of the present disclosure. Process 100 includes pulping 102, pulp sheet forming 104, pressing 108, and one or more stages of drying 112. The process may also include reeling 116, in which the fluff pulp sheet is wound into roll form. The forming of fluff pulp sheets begins with pulping 102, in which pulp raw materials, such as wood, fiber crops, etc., are pulped in a chemical pulping process. The chemical pulping process can be any conventional pulping process that arrives at fluff pulp fibers, such as Kraft pulping, sulfite pulping, etc. The slurry of pulped fibers can then be optionally bleached with chlorine or chlorine-free compounds, for example.

The fluff pulp, typically in a slurry, resulting from pulping 100 is then poured onto a moving screen at pulp sheet forming 104 in order to form a fluff pulp sheet. As the fluff pulp slurry travels on the moving screen, one or more processes may occur to remove moisture from the fluff pulp slurry. For example, a mechanical press can be used to force liquid out of the fluff pulp at pressing 108, and/or heat, air flow, etc., can be employed at drying 112, to remove liquid from the fluff pulp. Drying 112 can be carried out in one or more stages, including a first stage of drying 112A and a second stage of drying 112B. The fluff pulp sheet may then be rolled into roll form at reeling 116. In some embodiments, the fluff pulp sheet prior to roll form has a moisture content of 10% or less, and in some embodiments between 6% and 10%, and has a pulp density of less than 0.650 g/cm$^3$, and in some embodiments between about 0.500 g/cm$^3$ and 0.610 g/cm$^3$.

In embodiments in accordance with the present disclosure, a sizing agent is added to the fluff pulp. In some embodiments, one or more sizing agents can be added to the fluff pulp during the fluff pulp sheet forming process. For example, in some embodiments, the one or more sizing agents can be added before pulp sheet forming 104 when the fluff pulp is in a slurry, after pressing 108, when fluid from the pulping process is pressed out of the fluff pulp, and/or after the first and/or second stages of drying 112A, 112B, where additional moisture is removed from the fluff pulp. When adding the sizing agent before pulp sheet forming 104, the sizing agent may be in a dispersed or emulsified form. When adding the sizing agent to the fluff pulp sheet after pressing and/or drying, techniques including but not limited to spraying, showering, and/or dipping techniques may be employed. In some of these embodiments, the sizing agent may be in a melted or neat form.

In accordance with aspects of the present disclosure, a sizing agent may be additionally or alternatively added to post processed fluff pulp (e.g., after the fluff pulp sheets are reeled into roll). In these embodiments, the rolled fluff sheet can be unwound at a pulp roll unwind stand, treated with a sizing agent via spray, shower, and/or dipping techniques, and then rerolled into roll form by a rewinder, as shown in the process 200 of FIG. 2. Optional processes may be carried out after the sizing agent is added. For example, the sized fluff pulp sheet can be dried with an optional dryer or cured at an option curing station.

It will be appreciated that in embodiments of the present disclosure the sizing agent is generally non-uniform in its interaction with and/or coverage on the composition of fibers of the sized fluff pulp sheet. As such, the sized fluff pulp sheets may include fibers, or portions thereof, with and without a sizing agent adhered or otherwise coupled thereto. Similarly, certain sections of the sized fluff pulp sheets may include fibers, or portions thereof, with and without a sizing agent adhered or otherwise coupled thereto.

As a result of the addition of a sizing agent to fluff pulp in accordance with embodiments of the present disclosure, a composition of sized fluff pulp fibers, and/or a sized fluff pulp sheet, or sections thereof, may be produced with one or more of the following characteristics: a soak and drip capacity of less than 15 grams/gram; an air laid pad wicking rate of less than 3.0 mm/s; a fiberization energy of less than 120 kJ/kg, and less than 80 kJ/kg in some embodiments; a fiberized knot percentage of less than 30 percent, and less than 5% in some embodiments; and any combination thereof.

Test Methods

In the non-limiting examples that follow, the following test methods were employed to determine various reported characteristics and properties of the fluff pulp sheets. ASTM refers to the American Society of Testing Materials.

Fiberization energy testing is used to measure the amount of energy required to fiberize the fluff pulp sheet during the fiberization process. Fiberization energy can be measured by fiberizing a fluff pulp sheet using a laboratory hammermill, such as one available from Kamas Laboratory. One model suitable for testing is model number 9.188.3422, type KVARN K.01. This type of hammermill provides the ability to measure power consumption during the fiberization process, which can be displayed as a readout on an associated control panel. For testing the fluff pulp sheet samples described below, the hammermill was equipped with a screen having 19 millimeter (mm) round holes. During testing, the breaker bar gap was adjusted to 2.6 mm, the rotor speed was 3300 revolutions per minute (rpm) and the pulp feed rate was 2.8 grams/second (g/s). A vacuum cleaner was used to provide air flow through the hammermill and draw the fiberized fluff through the screen. The air flow from the vacuum cleaner was 1500-2000 cubic feet per minute (CFM).

Fluff pulp sheet samples to be tested were cut into 2 inch wide by 18 inch long strips. The strips were conditioned at 50% relative humidity (RH) and 70° F. (21.1° C.) for at least four (4) hours prior to measurement. The room where the test hammermill was located was also conditioned to 50% RH. The energy requirement values reported are an average of 10 individual readings.

Knot percentage testing is used to measure the percentage of knots. Fluff generated by the test hammermill during the fiberization process described above was tested for knots content with a Defiberization Efficiency (DE) test apparatus manufactured by Courtray Consulting Labservice, 2 rue Charles, MONSARRAT, 59500 Douai France. This device uses a series of standard ASTM mesh screens to separate fluff into knots and accepts. In this test procedure, knots are the fraction that is retained on an ASTM 12 mesh screen.

Soak and drip capacity testing is used to measure the liquid absorption and retention characteristics of the fluff pulp. In the soak and drip capacity test, a sample of fiberized fluff was sealed inside a heat sealable teabag and submerged in a 0.9% saline solution for 30 minutes. After the 30 minute saturation time, the bags were allowed to drip for three (3) minutes. The capacities were calculated by measuring the amount of fluid remaining in fluff after the drip period, dividing by the weight of the original fluff.

The fiberized fluff for the soak and drip capacity test can be fiberized by the test hammermill as described above, or by a blender according to the following procedure. The fiberized fluff generated by either procedure can be used in wicking rate or soak and drip capacity tests.

Samples of fluff pulp sheets where conditioned at 50% RH and 70° F. (21.1° C.) for four (4) hours prior to fiberization. The fluff pulp sheets to be fiberized were torn into small pieces (approximately 0.5 g each). About 1.5 g of the pulp sheet pieces where weighed, and then placed in the blender, such as a Waring Blendor, model 31BL92I (7011). To fiberize the pieces of fluff pulp, the blender is started under the high setting and run for 30 seconds, a duration adequate to achieve complete fiberization of 1.5 g pulp sample. Running the blender for longer times will increase the risk of fiber damage and fines generation.

The materials, procedure, and calculations to determine soak and drip capacity were as follows.

Test equipment:

- teabag paper 3 inches (75 mm) wide, heat-sealable, or presealed material 60×85 mm, examples of which are commercially available from Ahlstrom Fiber Composites Division, Edinburgh, Scotland;
- screen Teflon®-coated, 0.25-inch (6-mm) mesh, available from Eagle Supply and Plastic, Inc., part #7308 or equivalent;
- a heat sealer, such as Clamco Model 450 or equivalent;
- a swelling container—polyethylene, approximately 400×250×50 mm;
- testing fluid: 0.9% (w/w) aqueous isotonic saline;
- a paper cutter; a balance; a timer; a paper toweling; and a writing instrument, such as a pen.

The teabags are prepared as follows. First, the teabag paper is cut to a length of approximately five (5) inches. The sealable sides are folded together forming 2.5"×3" teabags, and the two edges are sealed so that the inside of the sideseals are ~0.25" (6 mm) from the edge of the bag. The inside dimensions of the bag should measure ~50 by 63 mm.

Once the teabags were prepared, the following procedure was carried out in order to test the soak and drip capacity of the fluff pulp:

1. Weigh empty labeled teabag to the nearest 0.001 gram (g) and record (Wt 0);
2. Using a balance, measure out 0.200±0.005 g of fiberized fluff to be tested;
3. Transfer into teabag and heat seal the open edge;
4. Weigh the fluff-filled specimen teabag to the nearest 0.001 gram and record (Wt 1);
5. Repeat steps 1-4 for all specimens;
6. Weight two (2) empty or "blank" teabags to the nearest 0.001 gram, and record. Calculate average weight of the blanks (Wb 0);
7. Fill container with ~1.5" of testing fluid;
8. Place the fluff-filled specimen teabags as well as the two (2) blank teabags on one dry piece of mesh screen. The teabags should not be touching. For the fluff-filled specimen teabags, make sure that the fibers are evenly distributed in the center of the bag and away from the seals.
9. Place another screen over the teabags;
10. Gently immerse the fluff-filled specimen teabags and blank teabags in the testing fluid. Start timer for 30±1 minute;
11. After the saturation time has elapsed, remove the fluff-filled specimen teabags and blank teabags from the testing fluid, and allow them to drip for 3 minutes. After the allotted drip time, weigh each fluff-filled specimen teabag to the nearest 0.001 gram and record (Wt 2), and weigh each blank teabag to the nearest 0.001 gram and record. Calculate average weight of the blanks (Wb 2).
12. Calculate the soak and drip capacity for each fluff-filled specimen.

The soak and drip capacity can be determined by the following equation.

$$\frac{Wt\,2 - Wt\,1 - Wb\,2 + Wb\,0}{Wt\,1 - Wt\,0}$$

Wicking rate testing is used to measure the wicking rate in a fluff pulp pad. Samples to be tested can fiberized either in the test hammermill or in a blender as described above. In the wicking rate test, a fluff pulp pad was formed in a pad former, using a Plexiglas tube having dimensions of 16 cm tall and an internal diameter of 5.7 cm, and a wire screen disposed on the bottom of the tube. The weight of the pad was four (4) g. A weighted plunger was placed on top of the pad and the height of the pad under load was measured. The load exerted by the weight on the pad was 2.5 kiloPascals. Water was then introduced into a well in which the tube is resting. The time it took for the water to wick through the pad from the top to the bottom was measured. After the water wicked through the pad, the height was again measured with the load still applied to the pad. The wicking rate was calculated by dividing the height of the pad by the time it takes for the water to wick through the pad. Since the height of the pad generally decreases as the pad becomes wet, the average of the wet and dry heights is used for the calculation.

Example 1

Laboratory Sizing Study—Wicking Rate, Fiberization Energy and Knots

The following experiment was carried out to compare the effects of three (3) different sizing agents on wicking rate, fiberization energy and knots percentage of a debonded fluff pulp. The sizing agents were applied on commercially available fluff pulp sheets. After the application of the sizing agents, the treated sheets were aged for two weeks either at room temperature or in an oven at 38° C. (100.4° F.).

CF405 fluff pulp, manufactured by Weyerhaeuser NR in Columbus Miss., was used in this experiment. CF405 fluff pulp is a bleached kraft southern pine fluff pulp containing a debonding agent. Three sizing agents were added to the CF405 fluff pulp: Aquapel 650; Hercon 100; and Hercules 5218, all available from Ashland Inc. Each of these sizing agents is an AKD-water emulsion having approximately 15% solids.

All sizing agents were applied at 0.25% level (0.25 g of sizing agent per 100 grams pulp (dry solids basis)). The sizing agents were applied by drawing the desired weight of sizing agent solution into a syringe and then applying the sizing agent onto the pulp sheet in evenly space lines roughly ¼-½ inch apart. The treated pulp sheets were wrapped in foil and aged two (2) weeks either at ambient room temperature or in a forced air lab oven held at 38° C. (100.4° F.). Pulp sheet samples without sizing treatment (i.e., control samples) were also wrapped in foil and aged under the same conditions as the sized samples.

The pulp sheet samples to be oven aged after treatment were preheated in a 60° C. (140° F.) oven for at least two (2) hours prior to the application of the sizing agent. The control samples were also preheated. The moisture content of these preheated samples was 2.3% prior to the application of the sizing agent. The sizing agents were diluted to 2.78% solids prior to application so that the moisture content of the treated sheets was 9.99%.

The pulp sheet samples to be aged at room temperature were not preheated. The moisture content of these samples prior to sizing application was 5.9%. The sizing agents were diluted to 4.9% solids prior to treating these samples so that the final moisture content of the treated pulps samples was 9.99%.

After the samples had been aged for two (2) weeks, the samples were conditioned overnight at 50% RH and 70° F. (21.1° C.) prior to testing. The samples were then tested to determine fiberization energy, knots percentage, and wicking rate in accordance with the testing procedures described above. The results are summarized in Table 1 below. The results demonstrate that it is possible to obtain a fluff pulp with very low wicking rates while retaining beneficial fiberization energy and knots percentage levels.

TABLE 1

| Sizing Agent | Aging Temperature | Fiberization Energy (kJ/kg) | Knot % | Wicking Rate (mm/s) |
|---|---|---|---|---|
| none (control) | Ambient | 37 | 0 | 3.8 |
| none (control) | 38 C. | 37 | 0 | 3.6 |
| Aquapel 650 | Ambient | 36 | 0 | 0.8 |
| Aquapel 650 | 38 C. | 34 | 0 | <0.1 |
| Hercon 100 | Ambient | 37 | 0 | 0.1 |
| Hercon 100 | 38 C. | 34 | 0 | <0.1 |
| Hercules 5218 | Ambient | 35 | 0 | <0.1 |

Example 2

Laboratory Sizing Study—Wicking Rate, Fiberization Energy, Soak and Drip Capacity, and Knots Percentage The following experiment was carried out to compare the effects of one (1) sizing agent on wicking rate, fiberization energy, soak and drip capacity and knots percentage of a non-debonded fluff pulp. In this experiment, a sizing agent (Aquapel 650) was applied to CF416 fluff pulp at two different application levels, 0.5 grams of sizing agent solids per 100 grams of dry fibers, and 0.75 grams of sizing agent solid per 100 grams of dry fibers. After the application of the sizing agents, the treated sheets were aged in a laboratory oven held at 60 C (140° F.) for approximately 20 hours. After the 20 hours of aging time, the pulp sheets were allowed to stand at 50% RH and room temperature for at least 4 hours before testing.

CF416 is a fluff pulp manufactured by Weyerhaeuser NR in Columbus, Miss. It is made without a debonding agent. Aquapel 650 is an AKD-water emulsion sizing agent manufactured by Ashland Inc. Prior to use, the sizing agent was diluted from the as-received solids level of 15% to 10% in order to facilitate more uniform application.

The sizing agent was applied on the pulp sheet by drawing the desired weight of the sizing solution into a syringe and then expressing the sizing agent onto the pulp sheet in evenly spaced lines one quarter to one half an inch apart. After the sizing agent was applied, the treated sheets were placed directly in a lab oven for aging. An untreated control was also prepared which contained no sizing agent and was stored at room temperature rather than being placed in the oven.

The samples were then tested to determine fiberization energy, knots percentage, soak and drip capacity and wicking rate in accordance with the testing procedures described above. The results are summarized in Table 2 below. The results demonstrate that it is possible to obtain a fluff pulp from a non-debonded fluff pulp with very low wicking rates and soak and drip capacities while retaining beneficial fiberization energy and knots percentage levels.

TABLE 2

| Sizing Agent % | Soak and Drip Capacity (g/g) | Fiberization Energy (kJ/kg) | Knot % | Wicking Rate (mm/s) |
|---|---|---|---|---|
| none (control) | 20.4 | 105 | 5 | 9.6 |
| Aquapel 650 - 0.5% | 7.5 | 89 | 4 | <0.1 |
| Aquapel 650 - 0.75% | 5.1 | 82 | 4 | <0.1 |

Example 3

Laboratory Sizing Study—Soak and Drip Capacity

In this experiment, a sizing agent (Aquapel 650) was applied to CF405 fluff pulp at two different addition levels, 0.25% (0.25 grams of sizing agent solids per 100 grams of dry fiber) and 0.50% (0.5 grams of sizing agent solids per 100 grams of dry fiber). The sizing agent in this experiment was applied in the same manner as described above in Example 1, except that the sizing agent was applied as received without dilution and the pulp sheets were all at ambient temperature when the sizing agent was applied.

After the sizing agent was applied, the fluff pulp sheets were wrapped in foil and aged in a forced air lab oven at 60° C. (140° F.) for four (4) hours. A sample of untreated CF405 was also oven-aged in the same manner to serve as a control. After four (4) hours of aging, the samples were removed from the oven and fiberized in a blender according to the test procedures described above. Soak and drip capacity tests were performed on the fiberized fluff samples according to test methods as described above. Results of these tests are summarized in Table 3. These results show that it is possible to produce a fluff pulp having very low soak and drip capacity.

TABLE 3

| Sizing Agent Application Level % | Soak and Drip Capacity (g/g) |
|---|---|
| 0 (control) | 22.6 |
| 0.25 | 5.4 |
| 0.50 | <0.5 |

Example 4

Roll Application Study

Figure 2:
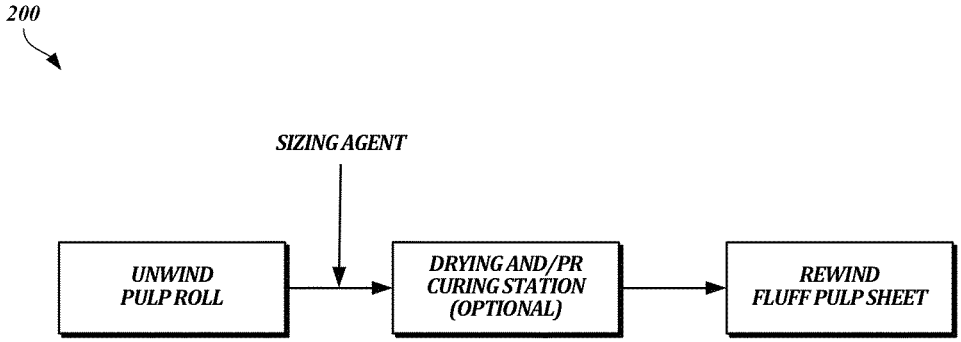
FIG. 2 illustrates a representative post production process for adding a sizing agent to a fluff pulp sheet in roll form in accordance with aspects of the present disclosure.

In this experiment, a sizing treatment process set forth in FIG. 2 was carried out. In that regard, a small roll of CF405 fluff pulp was mounted on an unwind stand and threaded onto a rewinder. A shower bar was mounted over the fluff pulp sheet. A pump was used to pump sizing solution out of a vat through the shower bar and onto the fluff pulp sheet as it was being wound from the unwind stand onto the rewind spool. The shower bar had a row of nozzles spaced ¼ inch apart across the width of the fluff pulp sheet. The diameter of the nozzle orifices was 30 thousandths of an inch. The sizing solution employed Aquapel 650 as the sizing agent, and had a solids level of the 16%.

After the fluff pulp roll had been treated, it was wrapped with plastic film stretch wrap and stored prior to testing. After two (2) weeks, a sample was removed for fiberization energy testing and knots percentage testing according to the test methods described above. The results are summarized in Table 4.

TABLE 4

| Sizing Treatment | Fiberization Energy (kJ/kg) | Knot % |
|---|---|---|
| 0 (control) | 40 | 0 |
| 0.7% | 65 | 1 |

After 10 weeks of storage, sized fluff pulp sheet samples were unwound from the roll for testing. Prior to testing the sized fluff pulp sheet samples were given an additional aging treatment in a forced air lab oven. The aging times and temperatures are indicated in Table 5 below. After the samples were oven aged, they were fiberized in a blender as described above and tested for soak and drip capacity according the test methods described above. The test results are summarized in Table 5. Table 5 also includes data for untreated CF405 from Table 3.

The results show that a small reduction in soak and drip capacity occurred after the pulp had been aged 10 weeks at ambient temperature, and further capacity reduction could be brought about through heat treatment.

TABLE 5

| Sizing Treatment | Oven Aging Time | Oven Aging Temperature | Soak and Drip Capacity (g/g) |
|---|---|---|---|
| 0 (control) | 4 hours | 60° C. (140° F.) | 22.6 |
| 0.7% | 30 seconds | 93° C. (199.4° F.) | 16.1 |
| 0.7% | 2 minutes | 93° C. (199.4° F.) | 15.4 |
| 0.7% | 30 seconds | 177° C. (350.6° F.) | 7.6 |
| 0.7% | 2 minutes | 177° C. (350.6° F.) | 6.6 |

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A fluff pulp sheet, comprising:

a composition including pulp fibers and a sizing agent, the composition having a soak and drip capacity of less than 15 grams/gram, and an air laid pad wicking rate of less than 3.0 mm/s;

wherein the fluff pulp sheet has a density of less than 0.650 g/cm$^3$ and a moisture content of less than 10%.

2. The fluff pulp sheet of claim 1, wherein the composition also has a fiberized knot percentage of less than 30%.

3. The fluff pulp sheet of claim 2, wherein the composition also has a fiberization energy of less than 120 kJ/kg.

4. The fluff pulp sheet of claim 1, wherein the composition also has a fiberization energy of less than 120 kJ/kg.

5. The fluff pulp sheet of claim 1, wherein the composition also has a fiberized knot percentage of less than 5% and a fiberization energy of less than 80 kJ/kg.

6. The fluff pulp sheet of claim 1, wherein the composition further includes a debonding agent.

7. The fluff pulp sheet of claim 1, wherein the sizing agent includes one or more AKD-water emulsions.

8. A non-woven article made from the fluff pulp sheet of claim 1.

9. A non-woven article made from the fluff pulp sheet of claim 1 and fibers selected from a group consisting of synthetic fibers and natural fibers pulp fibers, and combinations thereof.

10. A fluff pulp sheet, comprising:

a composition including wood pulp fibers, a debonding agent, and a sizing agent, wherein the composition has a soak and drip capacity of less than 15 grams/gram and an air laid pad wicking rate of less than 3.0 mm/s;

wherein the fluff pulp sheet has a moisture content of less than 10%, and a density of less than 0.650 g/cm$^3$.

11. The fluff pulp sheet of claim 10, wherein the composition also has a fiberized knot percentage of less than 30%.

12. The fluff pulp sheet of claim 11, wherein the composition also has a fiberization energy of less than 120 kJ/kg.

13. The fluff pulp sheet of claim 10, wherein the composition also has a fiberization energy of less than 120 kJ/kg.

14. The fluff pulp sheet of claim 10, wherein the composition also has a fiberized knot percentage of less than 5% and a fiberization energy of less than 80 kJ/kg.

15. A fluff pulp sheet, comprising:

fluff pulp fibers; and a sizing agent;

wherein the fluff pulp sheet has a soak and drip capacity of less than 15 grams/gram, an air laid pad wicking rate of less than 3.0 mm/s, a fiberization energy of less than 120 kJ/kg, and a fiberized knot percentage of less than 30 percent.

16. The fluff pulp sheet of claim 15, wherein fluff pulp sheet has a fiberization energy of less than 80 kJ/k.

17. The fluff pulp sheet of claim 15, wherein fluff pulp sheet a fiberized knot percentage of less than 5%.

18. The fluff pulp sheet of claim 15, wherein the fluff pulp sheet has a moisture content of between 6% and 10%, and a density of between 0.500 g/cm$^3$ and 0.610 g/cm$^3$.

19. The fluff pulp sheet of claim 15, wherein the sizing agent includes one or more AKD-water emulsions.

20. The fluff pulp sheet of claim 15, further including a debonding agent.

* * * * *